United States Patent [19]

Kline

[11] Patent Number: 4,933,051

[45] Date of Patent: Jun. 12, 1990

[54] CYANIDE-FREE COPPER PLATING PROCESS

[75] Inventor: George A. Kline, Birmingham, Mich.

[73] Assignee: OMI International Corporation, Warren, Mich.

[21] Appl. No.: 382,441

[22] Filed: Jul. 24, 1989

[51] Int. Cl.[5] ..... C25D 3/38; C25D 21/18

[52] U.S. Cl. ..... 204/52.1; 204/237; 204/238

[58] Field of Search ..... 204/52.1, 232, 237, 204/238, 239, 240, 241, 228

[56] References Cited

U.S. PATENT DOCUMENTS

| | | | |
|---|---|---|---|
| 1,465,034 | 8/1923 | Antisell | 204/52.1 |
| 4,462,874 | 7/1984 | Tomaszewski et al. | 204/52.1 |
| 4,469,569 | 9/1984 | Tomaszewski et al. | 204/52.1 |
| 4,521,282 | 6/1985 | Tremmel | 204/52.1 |

*Primary Examiner*—G. L. Kaplan

*Attorney, Agent, or Firm*—Richard P. Mueller

[57] ABSTRACT

A process for electroplating copper from an aqueous alkaline non-cyanide bath has improved resistance to degradation. At least a portion of the plating bath is subjected to electrolysis by an insoluble anode to which the current is controlled independently from the current to the soluble copper anode in order to reduce the level of bath impurities and maintain the quality of the deposit.

17 Claims, No Drawings

CYANIDE-FREE COPPER PLATING PROCESS

BACKGROUND OF THE INVENTION

This invention relates to the art of electroplating. More specifically it relates to the art of copper plating in an aqueous alkaline substantially cyanide-free bath.

The use of cyanide salts in copper plating electrolytes has become environmentally disfavored because of ecological considerations. Accordingly, a variety of non-cyanide electrolytes for various metals have heretofore been proposed for use as replacements for the well-known and conventional commercially employed cyanide counterparts. For example, U.S. Pat. No. 3,475,293 discloses the use of certain diphosphonates for electroplating divalent metal ions; U.S. Pat. Nos. 3,706,634 and 3,706,635 disclose the use of combinations of ethylene diamine tetra (methylene phosphonic acid), 1-hydroxyethylidene-1,1-diphosphonic acid, and aminotri (methylene phosphonic acid) as suitable complexing agents for the metal ions in the bath; U.S. Pat. No. 3,833,486 discloses the use of water soluble phosphonate chelating agents for metal ions in which the bath further contains at least one strong oxidizing agent; while U.S. Pat. No. 3,928,147 discloses the use of an organophosphorus chelating agent for pretreatment of zinc die castings prior to electroplating with electrolytes of the types disclosed in U.S. Pat. Nos. 3,475,634 and 3,706,635.

While the electrolytes and processes disclosed in the aforementioned U.S. patents have provided satisfactory electrodeposits under carefully controlled conditions, such electrolytes and processes have not received widespread commercial acceptance as a direct result of one or more problems associated with their practice. A commercially significant problem associated with such prior art electrolytes has been inadequate adhesion of the copper deposit to zinc and zinc-based alloy and steel substrates. Another such problem relates to the sensitivity of such electrolyte systems to the presence of contaminants such as cleaners, salts of nickel plating solutions, chromium plating solutions and zinc metal ions, all of which are frequently introduced into the electrolyte during conventional commercial practice. Still another problem is the hazardous nature of strong oxidizing agents employed in certain of such prior art electrolytes.

U.S. Pat. Nos. 4,600,493 and 4,762,601 teach a process and apparatus useful in the replenishment of soluble cupric ions in an electroless copper bath. A dialysis cell employs membranes which prevent the passage of metal cations of the anode of the cell while permitting the passage of contaminant anions which are thereby removed from the electroless bath. There is no plating at the cathode; the solution in the anode compartment becomes contaminated and is therefore not suitable for return to the electroless bath.

U.S. Pat. No. 3,833,486 suggests the inclusion of a strong oxidizing agent in an electrolytic cyanide-free copper bath as a means of reducing the inefficiency resulting from the presence of contaminants. This method creates difficulties in practice because the presence of the oxidizing agent causes undesired side reactions and introduces the additional complications such as monitoring and controlling an additional bath component.

In U.S. Pat. Nos. 4,462,874 and 4,469,569, (commonly assigned) processes were proposed which provide an electrolyte which is cyanide-free, thus providing an environmentally manageable system; which claims to produce an adherent copper deposit on conductive substrates including steel, brass and zinc base metals such as zinc die casts and the like; which will efficiently produce ductile, fine-grained copper deposits at thicknesses usually ranging from about 0.015 to about 5 mils (0.000015 to about 0.005 inch); which is more tolerant of the presence of reasonable concentrations of contaminants such as cleaning compounds, salts of nickel and chromium plating solutions and zinc metal ions as normally introduced into a plating bath in a commercial practice; and which is of efficient and economical operation. The disclosures of these patents are expressly incorporated herein by reference. The processes of these patents provide for purification of the plating bath by including an auxiliary, insoluble anode in the plating bath in addition to the normal soluble copper anode. Both anodes are electrolyzed from a common bus bar. Although these processes accomplished their objective of improved deposit quality, they presented new problems. It was found that, in practice, difficulties were often encountered due to the parallel use of the two types of anodes which resulted in uncontrollable variations in current flow through the two types of anodes and a reduction in the efficiency of dissolution of the soluble copper anodes. Further, this system offered no flexibility with respect to the level of current being supplied to the insoluble anode, and was thus inefficient, as it has been discovered that the level of current needed is a fraction of that needed for the normal soluble anode—work piece cathode cell.

SUMMARY OF THE INVENTION

It has now been found that the effects of degradation in aqueous alkaline substantially cyanide-free baths can be reduced by employing the process described herein to help maintain the purity and efficiency of the bath while maintaining high quality deposits.

These results are obtained by subjecting at least a portion of the bath liquid to electrolysis by an insoluble anode and by further controlling the current to that anode independently from the current to the soluble copper anode. This may be accomplished within the plating bath itself or by separating a portion of the bath liquid to be electrolyzed in a separate cell where the separated liquid is physically contacted with the insoluble anode. In either case, the circuitry permits independent control of the current flow to the soluble copper anodes. The separated liquid is then returned or continuously recirculated to the main plating bath in a purified condition due to the oxidation occurring at the insoluble anode.

DETAILED DESCRIPTION OF THE INVENTION

The process of this invention may be employed in conjunction with any aqueous alkaline substantially cyanide-free copper plating process. Typically, the bath will contain cupric (Copper II) ions; a chelating agent such as an organo phosphonate; a buffering/stabilizing agent such as alkali metal carbonate; a grain refining agent; hydroxy ions to provide the desired pH value; and preferably a wetting agent.

The copper II ions may be introduced as a bath soluble and compatible copper salt, to provide a cupric ion concentration in an amount sufficient to electrodeposit copper, and generally ranging from as low as about 3 grams per liter to as high as about 50 grams per liter (g/l) under selected conditions. The preferred organophosphonate chelating agent may be HEDP, ATMP, EDTMP, or mixtures thereof. Preferably, 1-hydroxyethylidene-1,1-diphosphonic acid (HEPD), when employed by itself, is present in an amount of about 50 to about 500 g/l. When a preferred mixture of HEDP and aminotri—(methylene phosphonic acid) (ATMP) is employed, HEDP is present in an amount of at least about 50 percent by weight of the mixture. When a preferred mixture of HEDP and ethylenediamine tetra (methylene phosphonic acid) (EDTMP) is employed, HEDP is present in an amount of at least about 30 percent by weight of the mixture. However, all bath soluble and compatible salts and partial salts thereof may be employed. When mixtures of HEDP and ATMP or HEDP and EDTMP are employed as the chelating agent instead of HEDP by itself, a reduction in the concentration of the chelating agent can be used due to the increased chelating capacity of the ATMP and EDTMP compounds in comparison to that of HEDP. The concentration of the organo-phosphonate chelating agent will range in relationship to the specific amount of copper ions present in the bath and is usually controlled to provide an excess of the chelating agent relative to the copper ions present.

In addition to the foregoing, the bath typically contains an alkali metal carbonate as a stabilizing agent, which is typically present in an amount usually of at least about 5 g/l, up to about 100 g/l. The bath may also contain buffering and conductivity agents such as acetates, gluconates, formates, etc., as well as grain refining agents such as uracils, pyrimidines, thiazolines, organodisulfides, and derivatives of these materials such as 2-thiouracil.

The bath further contains hydroxyl ions to provide an electrolyte on the alkaline side with a pH of about 7.5 up to about 10.5; an alkalinity range of about pH 9.5 to about pH 10 is generally preferred. The bath may optionally and preferably further contain a bath soluble and compatible wetting agent present in an amount of about 0.1 to 1 g/l. Such agents include wetting agents such as long chain alkyl sulfates, for example 2-ethylhexyl sulfate.

The cyanide-free or substantially cyanide-free electrolyte as hereinabove described is employed for electrodepositing a fine-grained, ductile, adherent copper deposit on conductive substrates including ferrous-base substrates such as steel, copper-base substrates such as copper, bronze and brass; and zinc-base substrates including zinc die castings and zincated aluminum. The substrate to be plated is immersed in the electrolyte as a cathode with a soluble copper anode being employed. The electrolyte is electrolyzed by passage of current between the cathode and anode for a period of time of about 1 minute to as long as several hours, and even days, in order to deposit the desired thickness of copper on the cathodic substrate.

The bath may be operated at a temperature of from about 80° to about 170° F., with temperatures of about 130° to about 150° F., being preferred. The particular temperature employed will vary depending on the specific bath composition and can be controlled by the skilled artisan in order to optimize plate characteristics. The bath can be operated at a cathode current density of about 0.1 to about 250 amperes per square foot (ASF), depending on bath composition, employing a cathode to anode surface ratio usually of about 1:2 to about 1:6. As will be appreciated by the skilled artisan, the specific operating parameters and composition of the electrolyte will vary depending upon the type of basis metal being plated, the desired thickness of the copper plate to be deposited, and time availability in consideration of the other integrated plating and rinsing operations.

The process of the invention involves subjecting at least a portion of the bath liquid to electrolysis by an insoluble anode and controlling the current flow or applied potential to that anode independently from the current flow or applied potential of the soluble copper anode. This may be accomplished within the plating bath itself or in a separate electrolytic cell to which a portion of the plating bath liquid is transferred or circulated.

When the insoluble anode is incorporated in the plating bath the work piece may serve as the cathode for both anodes or a separate cathode may be employed. When an auxiliary cell is employed, a separate cathode, preferably one which is copper plateable, will, of course, be necessary.

The ratio of the surface area of the soluble/insoluble anode ranges from about 0.5:1 to 500:1. Preferably the ratio may range from 5:1 to 500:1, more preferably from about 5:1 to 200:1 and most preferably from about 20:1 to 100:1.

In the operation of the process of the present invention, whether with or without an auxiliary bath, the anode current density for the soluble anode will be that which is suitable for copper electroplating. Typically, such soluble anode current densities will be about 1–20 ASF, with current densities of about 5–15 ASF being preferred. For the insoluble anode, anode current densities of about 10–350 ASF may be used, with current densities of about 20–100 being preferred.

Preferably, the purification process involves the separation of a portion of the liquid from the plating bath and subjecting that liquid to a separate electrolysis step. Preferably, the liquid is extracted from and recirculated to the bath on a continuous basis using a flow-through auxiliary electrolytic bath so that a steady state composition in the main bath is achieved. The auxiliary bath may be physically separate from the main bath, or may be established within the main tank by means of a separator designed to physically and electrolytically separate the auxiliary bath from the main bath.

The insoluble anode employed (whether in the main or auxiliary bath) may, for example, be ferrite based as described in U.S. Pat. No. 4,469,569 or nickel-iron based as described in U.S. Pat. No. 4,462,874. The following have also been found effective: iridium oxide on titanium; conductive titanium oxide; high sulfur electroless nickel phosphorous; high sulfur electroplated nickel; platinum and platinum materials, including platinized titanium and platinized niobium; and magnetite. Preferably, the cathode will be copper plateable and may, for example, be composed of steel or stainless steel. It should be appreciated that certain anode types which are not typically "insoluble" in conventional cyanide-free copper plating systems may be employed as insoluble anodes in the methods of the present invention due to the independent current control described above. For example, a copper electrode which is operated at a much higher current density than the copper anode in the "plating" cell can be sufficiently polarized so that it is "insoluble" and therefore useful in the instant invention. Typically such higher current density will be above about 125 ASF and preferably will be 150–250 ASF, or higher. Where an auxiliary cell is employed, the ratio of cathode/anode area is typically in the range of 10:1 to 25:1.

Key to one embodiment of the invention is the selection of an appropriate barrier to retard the natural tendency of copper ions to migrate to and deposit on the surface of the cathode in the auxiliary bath. Any material which will at least partly retard this migration and is compatible with the bath conditions may be employed. Ion exchange resins, as well as porous and fine-meshed inert plastic and resins are suitable materials.

It has been found that the selection of the barrier material and auxiliary bath operating conditions may be coordinated to reduce the transport rate of copper ions to the auxiliary cathode. Use of a fine-mesh polypropylene bag over the cathode combined with high current density (in excess of 200 ASF) helps retard the depletion of copper ions in the liquid. Likewise, where the use of a barrier is impractical, the tendency of the copper to deposit on the cathode may be prevented by controlling current density.

Other preferred embodiments related to plating bath parameters may be found in U.S. Pat. Nos. 4,469,569 and 4,462,874, expressly incorporated herein by reference.

In order to further illustrate the process of the present invention, the following specific examples are provided. It will be understood that the examples as hereinafter set forth are provided for illustrative purposes and are not intended to be limiting of the scope of this invention as herein disclosed and as set forth in the subjoined claims.

EXAMPLES

Comparative Example

An aqueous alkaline non-cyanide bath was prepared containing the following:

| | |
|---|---|
| Copper (as acetate) | 9.5 g/l |
| 1-Hydroxyethylidene-1,1-diphosphonic acid | 101 g/l |
| Carbonate (as Potassium salt) | 18 g/l |
| 2-thiouracil | 1.2 ppm |
| Sodium 2-ethylhexyl sulfate | 130 ppm |
| pH adjusted with potassium hydroxide | 9.5–10.0 |

The bath was heated to 120°–130° F., and the solution was electrolyzed by passing current through soluble copper anodes connected in parallel with insoluble nickel/iron coated anodes at varying soluble to insoluble anode ratios. A steel cathode of 0.14 $ft^2$ total area was used to complete the circuit. Measurements were made of current passing through the insoluble anode at various total anode current densities.

| Total Current (amps) | % of Total Current Through Insoluble Anode at Specified Ratio of Soluble/Insoluble Anode Area | | |
|---|---|---|---|
| | 20:1 | 2:1 | 1:1 |
| 1.5 | 0% | 0 | 2.7 |
| 3.0 | 0 | 0.7 | 8.3 |
| 4.5 | 1.1 | 8.2 | 10.9 |
| 6.0 | 3.0 | 12.8 | 16.0 |
| 7.5 | 3.9 | 15.3 | 19.2 |
| 9.0 | 4.0 | 16.1 | 20.6 |

The results indicate that when the soluble and insoluble anodes are incorporated on the same bus bar it is difficult to attain a desired level of current flow through the insoluble anode. Satisfactory results of 5%, preferably 10% or more, are obtained only at high current levels or by using large surface area insoluble anodes (which result in a low area ratio).

EXAMPLE 1

An aqueous alkaline non-cyanide bath was prepared containing the following:

| | |
|---|---|
| Copper (as acetate) | 9.5 g/l |
| 1-Hydroxyethylidene-1,1-diphosphonic acid | 101 g/l |
| Carbonate (as potassium salt) | 18 g/l |
| 2-thiouracil | 1.2 ppm |
| Sodium 2-ethylhexyl sulfate | 130 pm |
| pH (adjusted with potassium hydroxide) | 9.5–10.0 |

The bath was electrolyzed with cathodic work pieces composed of steel, brass and zincated aluminum using soluble copper anodes. Plating was conducted under the following conditions:

| | |
|---|---|
| Temperature | 120 to 140° F. |
| Agitation | Air |
| Cathode current density | 5 to 35 ASF |
| Soluble anode current density | 5 to 20 ASF |

Replenishment was periodically accomplished through addition of copper (as acetate), 1-hydroxyethylidene-1,1-diphosphonic acid, carbonate (as potassium salt) and 2-thiouracil as required.

During the electroplating operation, 80 gal/hr of the bath was continuously separated, filtered using activated carbon, and passed through an auxiliary electrolytic bath employing a steel or stainless steel cathode and an insoluble anode composed of ferrite or nickel/iron surfaces and then returned to the main bath. The separated solution was electrolyzed using a separate, independently controlled rectifier.

The following conditions were employed in the auxiliary bath.

| | |
|---|---|
| Surface Area Ratio-Soluble/Insoluble Anode | 100:1 to 20:1 |
| Insoluble anode current density | 20 to 100 ASF |
| Surface Area-Auxiliary Cathode/Insoluble Anode | 10:1 to 25:1 |
| Auxiliary Bath Current (expressed as percentage of main bath current) | 5 to 35 |

It was found that impurities were oxidized and that acceptable quality copper deposits continued to be obtained on the work pieces throughout the run.

EXAMPLE 2

An aqueous alkaline non-cyanide bath was run in production in a barrel process for about 24 hours while containing the following:

| | |
|---|---|
| Copper (as acetate) | 5.6 g/l |
| 1-hydroxyethylidene-1,1- | 107 g/l |

-continued

| | |
|---|---|
| diphosphonic acid | |
| Carbonate (as potassium salt) | 12.5 g/l |
| 2-thiouracil | 1.2 ppm (appx.) |
| Sodium 2-ethylhexyl Sulfate | 130 ppm (appx.) |
| pH (average) | 9.7 |

A portion of the bath was subjected to electrolysis in a separate auxiliary cell employing an insoluble anode, comprising a nickel-iron surface, and a cathode and a separately controlled rectifier, as in the previous examples. The area ratio of soluble anode in the main bath to insoluble anode in the auxiliary cell was about 1. The electrolyzed solution in the auxiliary cell was returned to the main bath. The total current was maintained at 30–400 amps, with 10% of the total employed in the auxiliary cell.

The quality of the deposits was maintained throughout the production run.

EXAMPLE 3

An aqueous alkaline non-cyanide bath was run in production in a rack process for about 24 hours while containing the following:

| | |
|---|---|
| Copper (as acetate) | 11.3 g/l |
| 1-hydroxyethylidene-1,1-diphosphonic acid | 125.4 g/l |
| Carbonate (as potassium salt) | 18 g/l |
| 2-thiouracil | 1.2 ppm (appx.) |
| Sodium 2-ethylhexyl Sulfate | 130 ppm (appx.) |
| pH (average) | 9.6 |

The process was operated as in the previous Example using an auxiliary cell but employing an insoluble anode comprising a ferrite surface.

Total current was maintained at 200–300 amps with 10–20% of the total employed in the auxiliary cell and a soluble: insoluble anode surface area ratio of about 60:1.

The quality of the deposits was again maintained throughout the production run.

EXAMPLE 4

An aqueous alkaline non-cyanide bath was prepared which contained the following:

| | |
|---|---|
| Copper (an acetate) | 9.5 g/l |
| 1-hydroxyethylidene-1,1-diphosphonic acid | 101 g/l |
| Carbonate (as potassium salt) | 18 g/l |
| pH (adjusted with KOH) | 9.5–10.0 |

Soluble copper anodes, insoluble nickel-iron anodes and steel cathode work pieces were immersed in the same bath. The current to the soluble and the insoluble anodes was controlled separately. The bath was electrolyzed and plating was carried out under the following conditions:

| | |
|---|---|
| Temperature | 120–140° F. |
| Agitation | Air |
| Cathode Current Density | 20 ASF |
| Soluble Anode Current Density | 15 ASF |
| Insoluble Anode Current Density | 307 ASF |
| Insoluble Anode Current (expressed as percentage of total plating current) | 32 |
| Surface area ratio of Soluble: Insoluble Anode | 40:1 |

Impurities were oxidized in the bath and acceptable quality copper deposits were obtained on the steel work pieces throughout the run.

EXAMPLE 5

An aqueous alkaline non-cyanide bath was prepared as in Example 1. Aliquots of the solution were electrolyzed in a standard Hull cell under the following conditions, using different materials as the anode:

| | |
|---|---|
| Sample size | 267 ml |
| Temperature | 130–140° F. |
| Total Current | 1 amp |
| Anode current density | 100–200 ASF |

With regard to the anode current density, where the anode material used was copper, the current density was 200 ASF. With the other anode materials, the current density was about 100 ASF. No soluble copper anodes were used and copper plating on the standard Hull Cell steel cathode was effected with the copper in the plating bath which was periodically replenished by the addition of copper salts.

Using this procedure, the following insoluble anode materials were tested:

Iridium oxide on Titanium
Titanium oxide
High sulfur electroless nickel phosphorous
High sulfur electroplated nickel
Platinum
Platinized titanium
O F H C copper
Phosphorized copper In each instance, copper was deposited on the cathode. The tested anode oxidized the electrolyte and prevented burning of the copper deposit. These results demonstrate the suitability of the materials tested based on their ability to form oxidation products without degradation of either the anode or the electrolyte.

What is claimed is:

1. A process for electroplating copper from an aqueous, alkaline substantially cyanide-free bath, which process employs both soluble and insoluble anodes and has an improved resistance to degradation, comprising:

(a) maintaining a main plating tank which contains said aqueous, alkaline, substantially cyanide-free copper electroplating bath having at least one soluble anode and a main copper plateable cathode immersed therein and an auxiliary cell which contains at least one insoluble anode and an auxiliary cathode;

(b) removing at least a portion of said electroplating bath from the main plating tank and introducing it into the auxiliary cell in physical contact with the insoluble anode and the auxiliary cathode;

(c) passing a current between said soluble anode and the main cathode and between said insoluble anode and the auxiliary cathode;

(d) independently controlling the current flow passing between said insoluble anode and said auxiliary cathode and the current flow passing between said soluble anode and said main cathode; and, (e) returning at least part of the liquid in said auxiliary cell to the main plating tank.

2. The process of claim 1 wherein the main cathode is the work piece to be plated.

3. The process of claim 1 wherein the auxiliary cathode is a copper-plateable material.

4. The process of claim 3 wherein the auxiliary cathode is composed of steel or copper.

5. The process of claim 3 additionally comprising the step of maintaining a barrier between the auxiliary cathode and the separated liquid sufficiently to reduce the amount of copper plated out on the cathode during electrolysis.

6. The process of claim 5 wherein the barrier is maintained by interposing an ion exchange membrane which inhibits the passage of copper ions between the separated liquid and the auxiliary cathode.

7. The process of claim 5 wherein the barrier is maintained by interposing a fine mesh polyalkylene bag between the separated liquid and the auxiliary cathode.

8. The process of claim 5 wherein a fine mesh polypropylene barrier is employed.

9. The process of claim 5 wherein the barrier comprises an ion exchange membrane.

10. The process of claim 1 wherein the current flow at the insoluble anode is controlled independently from that at the soluble anode by electrolyzing the separate anodes with separately controlled rectifiers.

11. The process of claim 1 wherein the current flow at the insoluble anode is controlled independently from that at the soluble anode by electrolyzing the separate anodes with the same circuit employing a control device to permit independent selection of the desired current flow of the two anodes.

12. The process of claim 11 wherein the circuit employs a rheostat.

13. The process of claim 1 wherein the ratio of the auxiliary cathode area to the insoluble anode area is from about 10:1 to 25:1.

14. The process of claim 1 wherein a portion of the plating liquid which is separated and electrolyzed as specified is returned to the electroplating bath in the main plating tank on a continuous basis.

15. The process of claim 1 wherein the separated liquid is additionally subjected to a filtration process.

16. The process of claim 1 wherein the insoluble anode has a ferrite surface.

17. The process of claim 1 wherein the insoluble anode has a nickel/iron surface.

* * * * *